US006977462B2

(12) United States Patent
Yamamoto et al.

(10) Patent No.: US 6,977,462 B2
(45) Date of Patent: Dec. 20, 2005

(54) FLUORESCENT LAMP HAVING PHOSPHOR LAYER

(75) Inventors: Kenji Yamamoto, Takatsuki (JP); Kenji Hirai, Sakai (JP); Shingo Matsuda, Takashima-gun (JP); Shinichiro Ishitsuka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 105 days.

(21) Appl. No.: 10/626,820

(22) Filed: Jul. 23, 2003

(65) Prior Publication Data

US 2004/0135487 A1 Jul. 15, 2004

(30) Foreign Application Priority Data

Jul. 30, 2002 (JP) ..... 2002-221395

(51) Int. Cl.[7] ..... H01J 61/35; H01J 61/42; H01J 65/04

(52) U.S. Cl. ..... 313/485; 313/635

(58) Field of Search ..... 313/484–489, 313/635, 493

(56) References Cited

U.S. PATENT DOCUMENTS

| | | | | |
|---|---|---|---|---|
| 5,227,693 A * | 7/1993 | Sakakibara et al. | ..... | 313/489 |
| 5,512,798 A * | 4/1996 | Honda | ..... | 313/489 |

FOREIGN PATENT DOCUMENTS

| | | | | |
|---|---|---|---|---|
| JP | 48-98985 | 11/1973 | | |
| JP | 54082874 A * | 7/1979 | ..... | H01J 9/22 |
| JP | 07021820 A * | 1/1995 | ..... | F21V 8/00 |
| JP | 09073884 A * | 3/1997 | ..... | H01J 65/04 |
| JP | 09-190802 | 7/1997 | | |
| JP | 10-312777 | 11/1998 | | |
| JP | 10-321194 | 12/1998 | | |
| WO | WO 2003046946 A1 * | 6/2003 | ..... | H01J 1/88 |

* cited by examiner

*Primary Examiner*—Mariceli Santiago

(57) ABSTRACT

An object of the present invention is to provide a fluorescent lamp including: a hermetically sealed lamp vessel; and a phosphor layer attached to a part of an inner surface of the lamp vessel, where a thickness of the phosphor layer near an edge thereof gradually and smoothly decreases towards the edge.

17 Claims, 6 Drawing Sheets

FLUORESCENT LAMP HAVING PHOSPHOR LAYER

This application is based on an application No. 2002-221395 filed in Japan, the content of which is hereby incorporated by reference.

BACKGROUND OF THE INVENTION (1) Field of the Invention

The present invention relates to a fluorescent lamp, and particularly relates to a fluorescent lamp that has a phosphor layer formed on an inner surface of its lamp vessel.

(2) Related Art

One kind of fluorescent lamps having a lamp vessel whose inner surface is formed a phosphor layer is electrodeless fluorescent lamp. The electrodeless fluorescent lamp is a fluorescent lamp that literally does not have any electrode. The electrodeless fluorescent lamp is getting attention since it has longer life than other kinds of fluorescent lamps whose life is mainly determined by electrode.

One type of such electrodeless fluorescent lamps has a structure of having a lamp vessel that has a tube-like concave portion whose hollow is formed like a tube, and a coil is provided in the concave portion. If alternating current having a high frequency is fed to the coil, an alternating magnetic field is generated inside the lamp vessel. This alternating magnetic field makes mercury atoms and electrons collide with each other in the lamp vessel, thereby making the mercury atoms emit ultraviolet light. The ultraviolet light emitted in this way will be irradiated on the phosphors applied on an inner surface of the lamp vessel, so as to generate visible light.

In relation to a method of producing the lamp vessel of the aforementioned electrodeless fluorescent lamp, the following mainly describes a process of applying phosphors, a process of drying thereof, and a process of removing unnecessary phosphors.

FIG. 1 is a diagram showing a series of steps adopted by the conventional technology.

An object shown in (a)–(d) of FIG. 1 which is formed as a flask having a round-bottom is a glass vessel 106, a part of which is used for a glass bulb 102 (see FIG. 2) of a lamp vessel 100 (see FIG. 2) Note that each glass vessel 106 in (a)–(d) of FIG. 1 is in a longitudinal sectional view.

First, an application solution 110 containing phosphor powders is injected into the glass vessel 106 whose opening is directed upward, with use of an injection nozzle 108, up to a level shown in FIG. 1(*a*) (so far, refer to FIG. 1(*a*)).

Next, the glass vessel 106 is made to stand in an inverted position, being rotated in the direction of the arrow D, so as to let out an excess of the application solution 110 from the glass vessel 106 (FIG. 1(*b*)). Here, the reason why the glass vessel 106 is rotated is to make the thickness of the application solution 110 attached to the inner surface of the glass vessel 106 as even as possible.

Then, while the glass vessel 106 is in an inverted position, a warm-air nozzle 112 is entered into the glass vessel 106, so as to dry the application solution 110 attached to the inner surface of the glass vessel 106 (FIG. 1(*c*)). Here, the reason why the drying step is performed while the glass vessel 106 is in an inverted position is to prevent the application solution. 110 from being accumulated at the bottom of the glass vessel 106, which results in making the thickness of the formed phosphor layer uneven.

After the application solution 110 is dried, and so the phosphor layer 114 is formed, unnecessary phosphor is removed which has been formed on the inner surface of the cylindrical part 116 of the glass vessel 106. For this removing step, a rubber blade 118 is used for example. This rubber blade 118 is inserted just before the spherical part 120 of the glass vessel 106. The reason why the rubber blade 118 is not inserted inside the spherical part 120 beyond the cylindrical part 116 will be detailed later. The rubber blade 118, by being rotated, scrapes the phosphor layer 114 off the inner surface of the cylindrical part 116(FIG. 1(*d*)). The following is the reason why the phosphor layer 114 is removed from the cylindrical part 116. That is, an internal tube 104 (detailed later) will be attached to the cylindrical part 116 by means of melting. In view of this, if there is phosphor left in the cylindrical part 116 which will be attached to the internal tube 104, a crack will likely occur in the attaching process, and further there is a possibility of leak due to incomplete attachment therebetween.

After the phosphor layer is formed at a predetermined area of the inner surface of the glass vessel 106 as aforementioned, an internal tube 104 is inserted therein as shown in FIG. 2, thereby determining the position of the internal tube 104. This internal tube 104 will be a storage of the coil. Then, a burner is used to heat the part of the external surface of the cylindrical part 116 that corresponds to an opening of the internal tube 104, while the internal tube 104 and the glass vessel 106 are being rotated around the tube axis of the internal tube, in a same direction and at a same speed. This operation attaches together the internal tube 104 and the glass vessel 106 by means of melting (hermetic sealing). Then, the part of the glass vessel which is shown in the broken line is cut, so as to complete the lamp vessel 100.

However, in the aforementioned lamp vessel 100, the edge of the phosphor layer 114 is square-cornered, as shown in "details of part E" of FIG. 2. This is because the phosphor layer 114 is removed by the rubber blade 118. Accordingly, at this angular part 122, some portions thereof are likely to fall off (chipping). When the electrodeless fluorescent lamp is illuminated, the pieces of the phosphor having fallen off will be seen as a shadow, from outside the electrodeless fluorescent lamp, which is a quality problem.

Note here that the reason why the rubber blade 118 is not inserted inside the spherical part 120 beyond the cylindrical part 116 is as follows. That is, if the phosphor layer is scraped off by inserting the rubber blade in such a way, the phosphor that has been scraped off will be stuck, in-powder forms, in the slope part 124 which is arc-shaped, the slope part 124 positioning between the cylindrical part 116 and the spherical part 120. If such remaining phosphor powders enter into the attaching part in the aforementioned attaching process, a crack or a leak occurs at the attaching part.

SUMMARY OF THE INVENTION

The object of the present invention, in order to solve the stated problems, is to provide a fluorescent lamp whose phosphor layer is prevented from falling off near the edge thereof.

The above object is achieved by a fluorescent lamp including: a hermetically sealed lamp vessel; and a phosphor layer attached to a part of an inner surface of the lamp vessel, where a thickness of the phosphor layer near an edge thereof gradually and smoothly decreases towards the edge.

According to the stated construction, the phosphor will not fall off, which tends to happen with conventional fluorescent lamps that have a phosphor layer whose edge is square-cornered. As a result, the fluorescent lamp of the present invention will be unlikely to have the problem that phosphor having fallen off will be seen from outside during the lamp illumination.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENTS

As follows, the present invention is described by way of an electrodeless fluorescent lamp.

Figure 1:
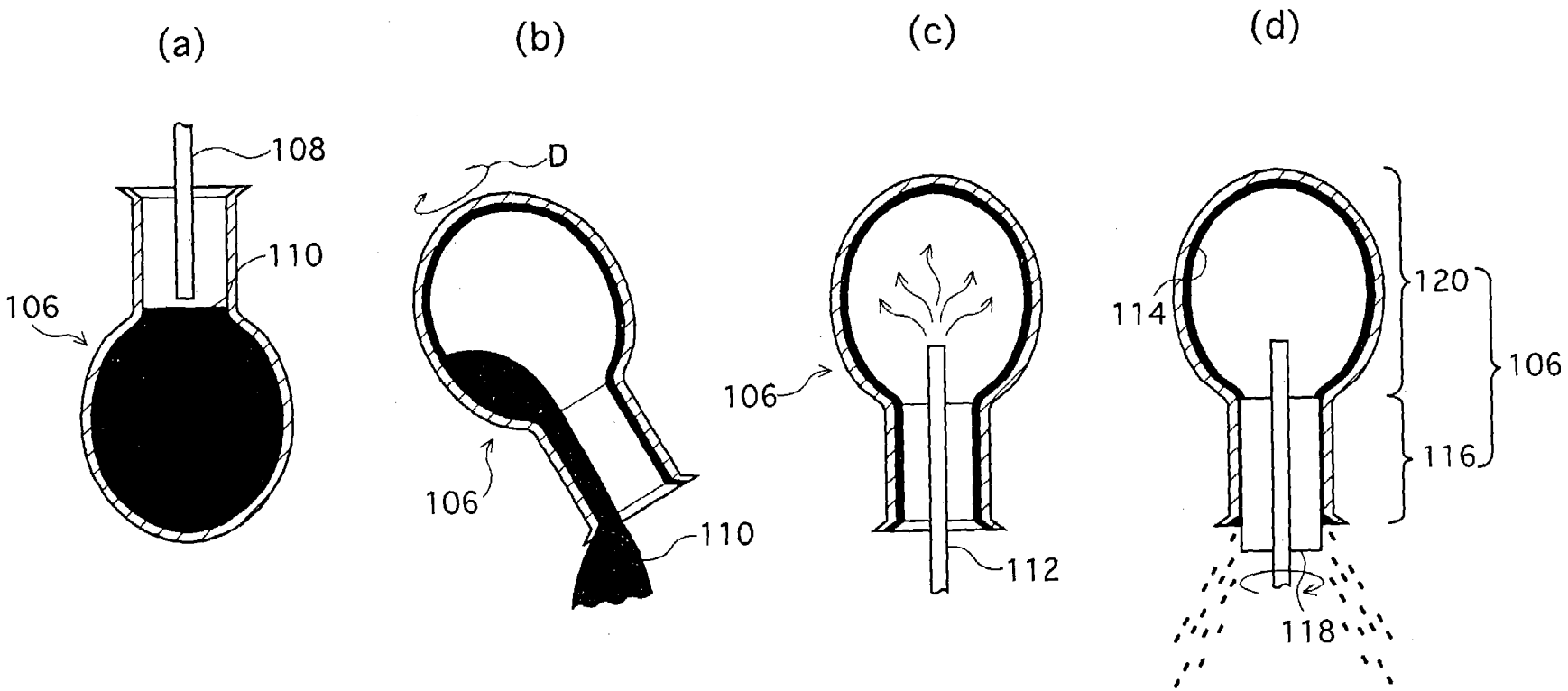
FIG.1 PRIOR ART
FIG. 1 is a diagram showing a series of steps performed in the production operation of electrodeless fluorescent lamp, relating to the conventional technology.
Figure 2:
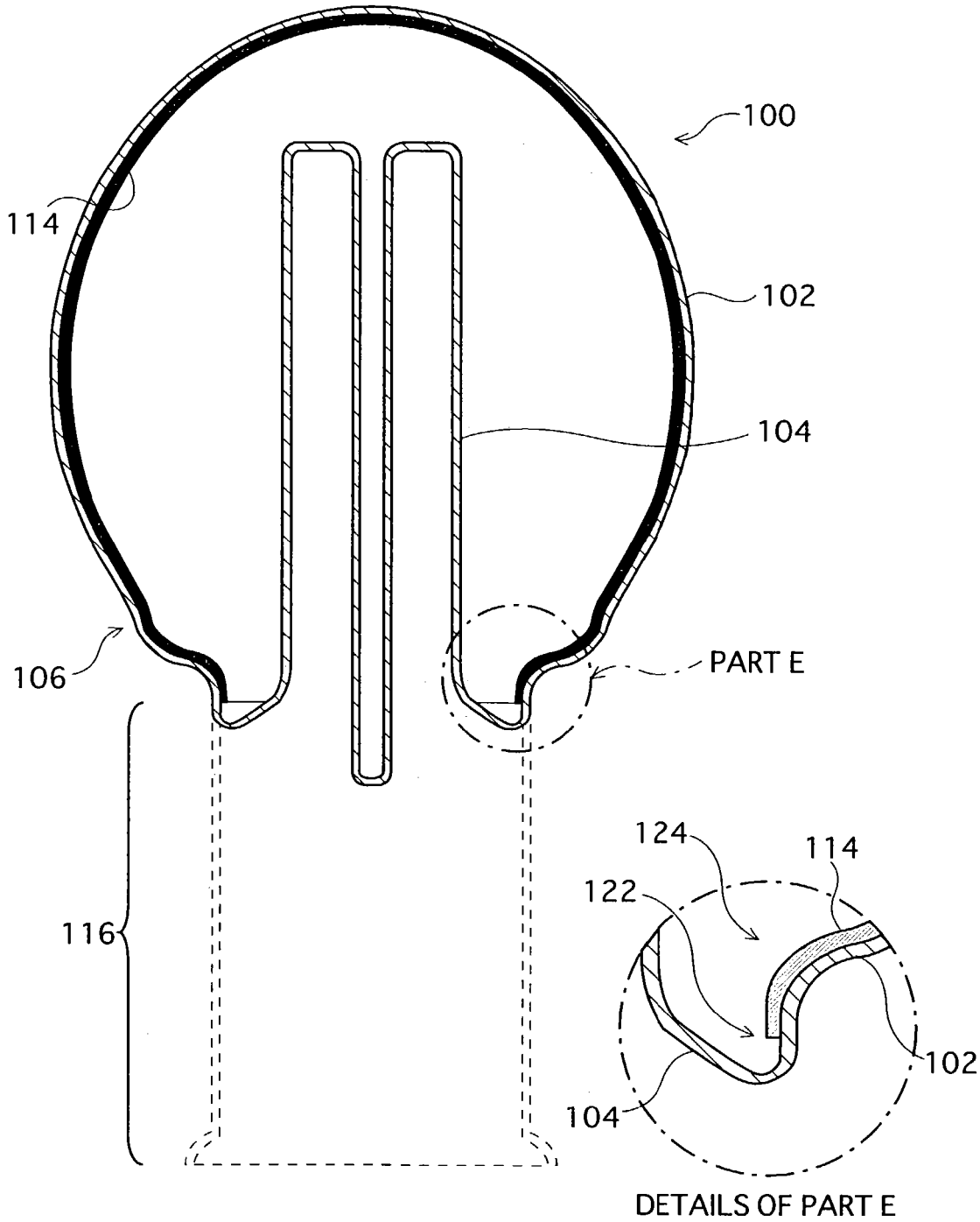
FIG.2 PRIOR ART
FIG. 2 shows an overall structure of the lamp vessel produced through the production process for the electrodeless florescent lamp, relating to the conventional technology.
Figure 3:
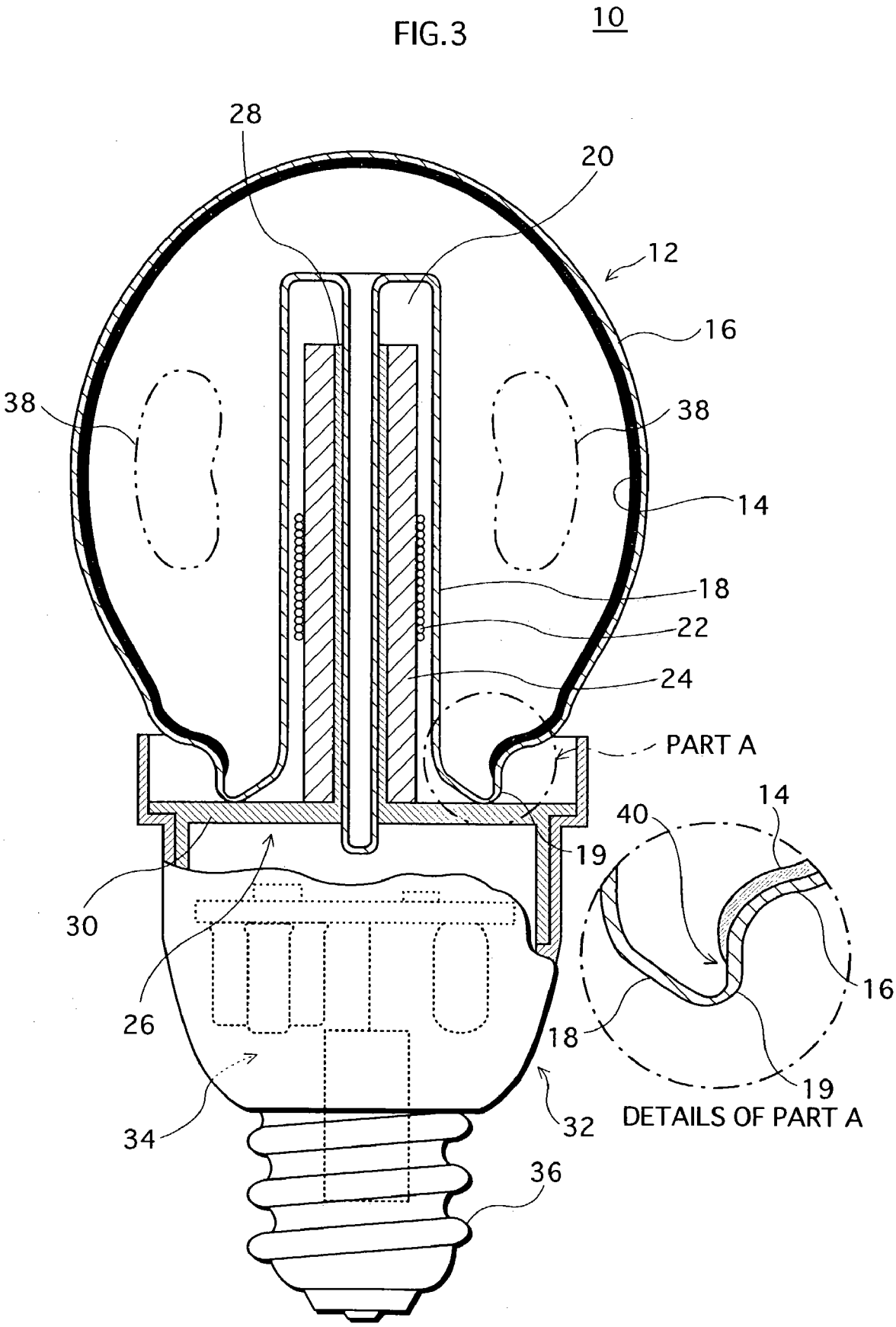
FIG. 3 shows an overall structure of the electrodeless fluorescent lamp, as a whole, which relates to the present embodiment.

FIG. 3 is a partly broken view of the electrodeless fluorescent lamp 10 of the present embodiment that uses the electromagnetic induction-coupling discharge (H discharge) This electrodeless fluorescent lamp 10 is hereinafter simply referred to as "electrodeless lamp 10".

The electrodeless lamp 10 has a lamp vessel 12 which is made of translucent glass and which has been hermetically sealed. A phosphor layer 14 is formed at a predetermined area of the inner surface of this lamp vessel 12, and a discharge material that includes mercury and an inert gas composed of such as argon and krypton is filled in the lamp vessel 12.

The lamp vessel 12 has a glass bulb 16 in a spherical shape and an internal tube 18. The internal tube 18 is not only used as a material for hermetically sealing the glass bulb 16, but also as a storage of a core 24 which will be detailed later. The glass bulb 16 is attached to the internal tube 18, at a position shown by the reference sign 19.

The internal tube 18 has a concave portion 20 that is in a tube-like shape, and the core 24 is provided in the concave portion 20. The core 24 has a coil wound around the outer surface of the core 24. The core 24 is made of a magnetic material and is shaped as a tube.

A cylindrical part 28 of an aluminum heat sink 26 is inserted in the core 24, towards the side of the inner radius of the core 24. The heat sink 26 is used to dissipate heat from the core 24, so as to prevent overheat of the core 24, and has a cup part 30 as an extension from the cylindrical part 28, and this cup part 30 is fixed to a circuit case 32 made of a synthetic resin.

The circuit case 32 stores therein a high frequency driving circuit 34 that is connected to the coil 22, so as to supply a high-frequency alternating current to the coil 22.

Furthermore, a base 36 having the same standard as general incandescent lamps is attached to the circuit case 32. Power from the commercial power source is supplied to a high frequency driving circuit 34 via this base 36.

In the electrodeless lamp 10 having the stated structure, an exciting current having a high frequency is fed to the coil 22 from the high frequency driving circuit 34, so as to have the mercury-including gas which has been enclosed in the lamp vessel 12 to generate a plasma discharge, at areas mainly shown by the reference sign 38. This plasma, working as a secondary coil, is then electrically coupled with the coil 22, so as to stabilize the state of discharge. This discharge causes mercury to emit ultraviolet light, and the emitted ultraviolet light is then irradiated on the phosphor included in the phosphor layer 14 on the inner surface of the lamp vessel 12, so as to generate visible light.

The phosphor layer 14 is formed on the substantially entire inner surface of the glass bulb 16, and the edge of the phosphor layer 14 positions a little behind the sealing part 19 of the glass bulb 16. Note here that the average thickness of the phosphor layer 14, which is formed substantially even, is about 20 $\mu$m, as opposed to the thickness of the glass bulb 16 which is around 1 mm. As can be inferred from this, the thickness of the phosphor layer 14 in the drawings is exaggerated, for convenience in explaining.

As shown in the details of Part A in FIG. 3, the thickness of the phosphor layer 14 in the vicinity of the edge thereof gradually and smoothly decreases towards the edge 40; that is, the vicinity of the edge of the phosphor layer 14 is formed to have a slope having an acute angle with respect to the inner surface of the glass bulb 16. In other words, the edge of the phosphor layer 14 is not square-cornered. As a result, the phosphor in the edge is prevented from falling off, and furthermore there is less possibility of the aforementioned problem that is attributable to the phosphor falling-off.

As follows, parts of the production process for the electrodeless lamp 10 structured as above are described, with reference to FIG. 4 and FIG. 5.

The glass vessel 42 in a round-bottom flask shape is a glass vessel, a part of which will become of the aforementioned glass bulb 16. The glass vessel 42 is made up of a cylindrical part 44 and a spherical part 46.

First, an injection nozzle 48 is entered in the glass vessel 42 whose opening is directed upward. Then the injection nozzle 48 injects an application solution 50 into the glass vessel 42 (FIG. 4(*a*)). The application solution 50 is obtained by mixing phosphor powders in an aqueous solution obtained by dissolving, in pure water, polyethylene oxide that is an adhesive polymeric material. The application solution 50 to be injected into the glass bulb 16 should be in an amount that is sufficient for coating the inner surface of the glass bulb 16, and should not be too much. That is, the amount of the application solution 50 should be small, relative to the volume of the glass vessel 42.

Figure 4:
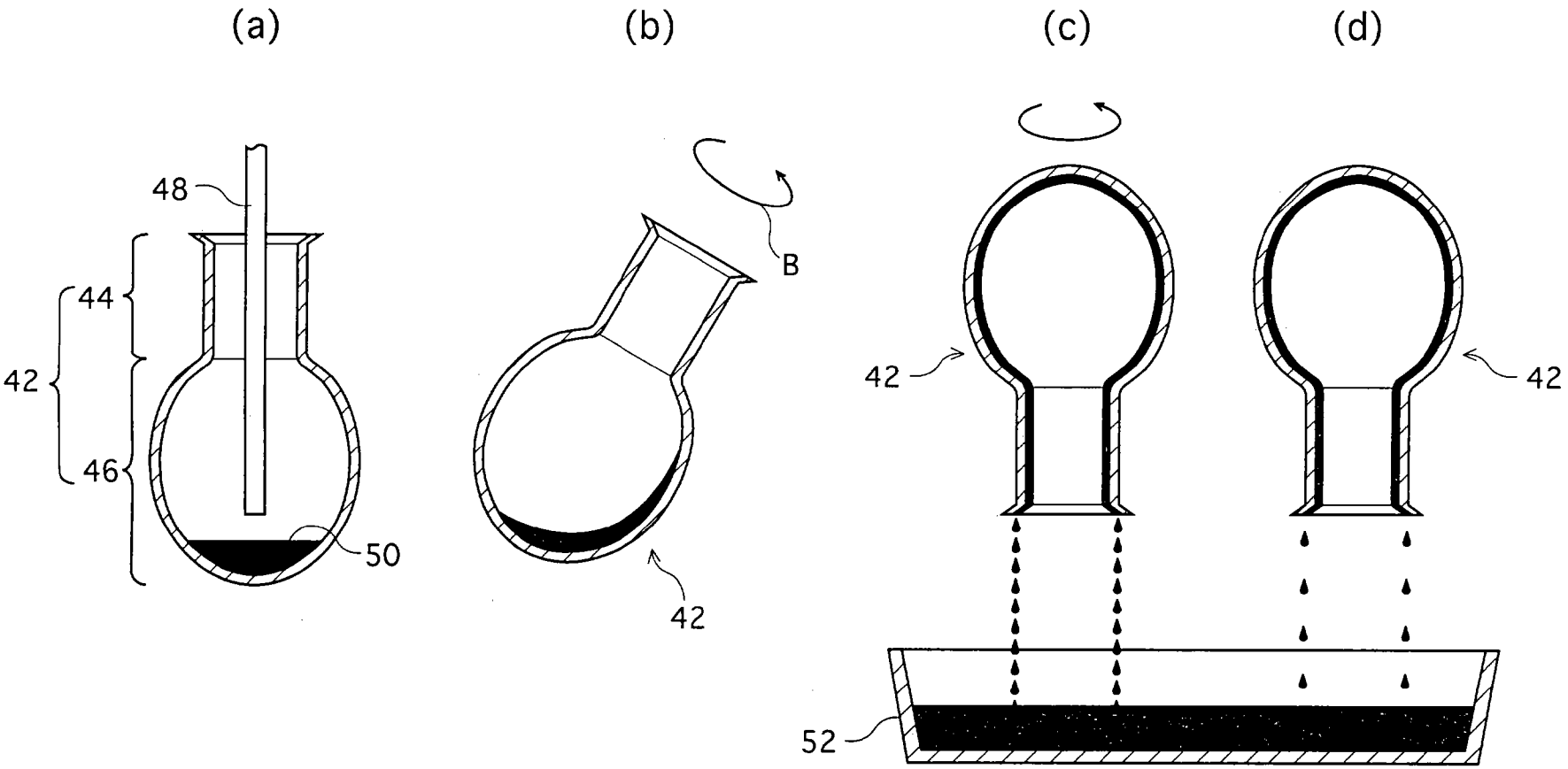
FIG. 4 is a diagram showing a part of the production process for the electrodeless fluorescent lamp of the present embodiment.

Next, the glass vessel 42 is gradually made to stand in an inverted position, while being rotated in the direction of the arrow B (FIG. 4(*b*)). The reason why the glass vessel 42 is rotated is to apply the small amount of injected application solution to the entire inner surface of the glass vessel 42, and also to prevent the application solution from remaining in stripes within the glass vessel 42.

Finally, the glass vessel 42 is completely in an inverted position (FIG. 4(*c*)). After a while, the rotation of the glass vessel 42 is stopped (FIG. 4(*d*)). Below the glass vessel 42, an application solution collection container 52 is provided, which will collect an application solution having dropped from the glass vessel 42.

Next, drying and partial removal of the application solution are performed. The partial removal is directed to the most part of the application solution attached to the cylindrical part 44. The purpose of this partial removal is, as aforementioned, to prevent any crack or leak, in sealing the glass bulb 26 with the internal tube 18.

Figure 5:
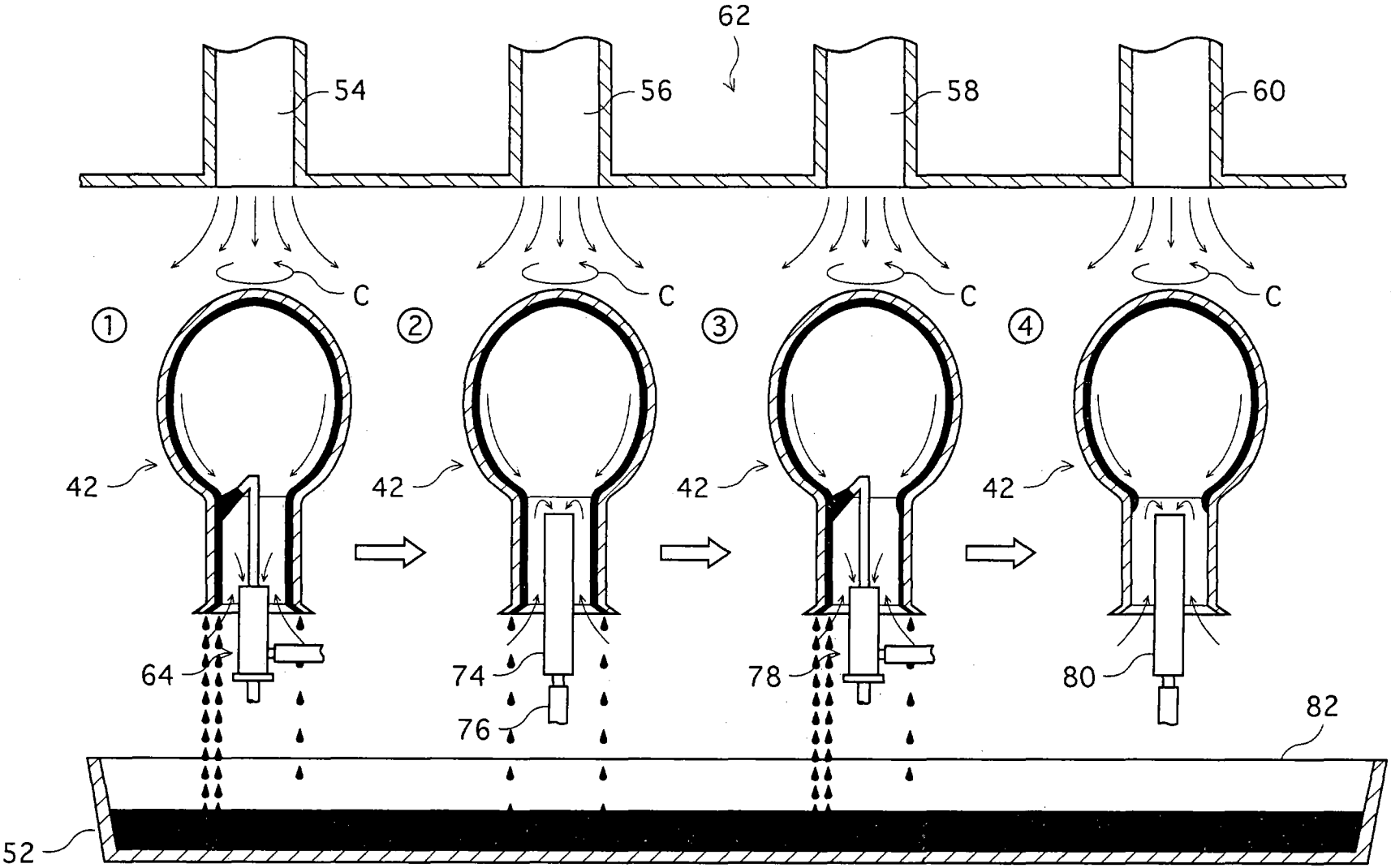
FIG. 5 is a diagram showing a part of the production process for the electrodeless fluorescent lamp of the present embodiment.

The drying and the partial removal of the application solution are performed by going through the four steps (①–④) shown in FIG. 5.

The glass vessel 42 is moved, keeping an inverted position, below the hot-air duct 62 composed of four outlets 54, 56, 58, and 60. The location of the glass vessel 42 is determined directly below each of the outlets 54–60. The glass vessel 42, at each determined location, is subjected to a hot air of about 200° C. blown from the corresponding outlet, for a predetermined period of time (e.g. about 40 seconds) and at the external round-bottom thereof. At the same time, at each location, the glass vessel 42 is subjected to a steam suction by which steam generated within the glass vessel 42 is removed by suction. In addition to these, in Step ① and Step ③, an excess of the application solution is removed by cleansing.

Figure 6:
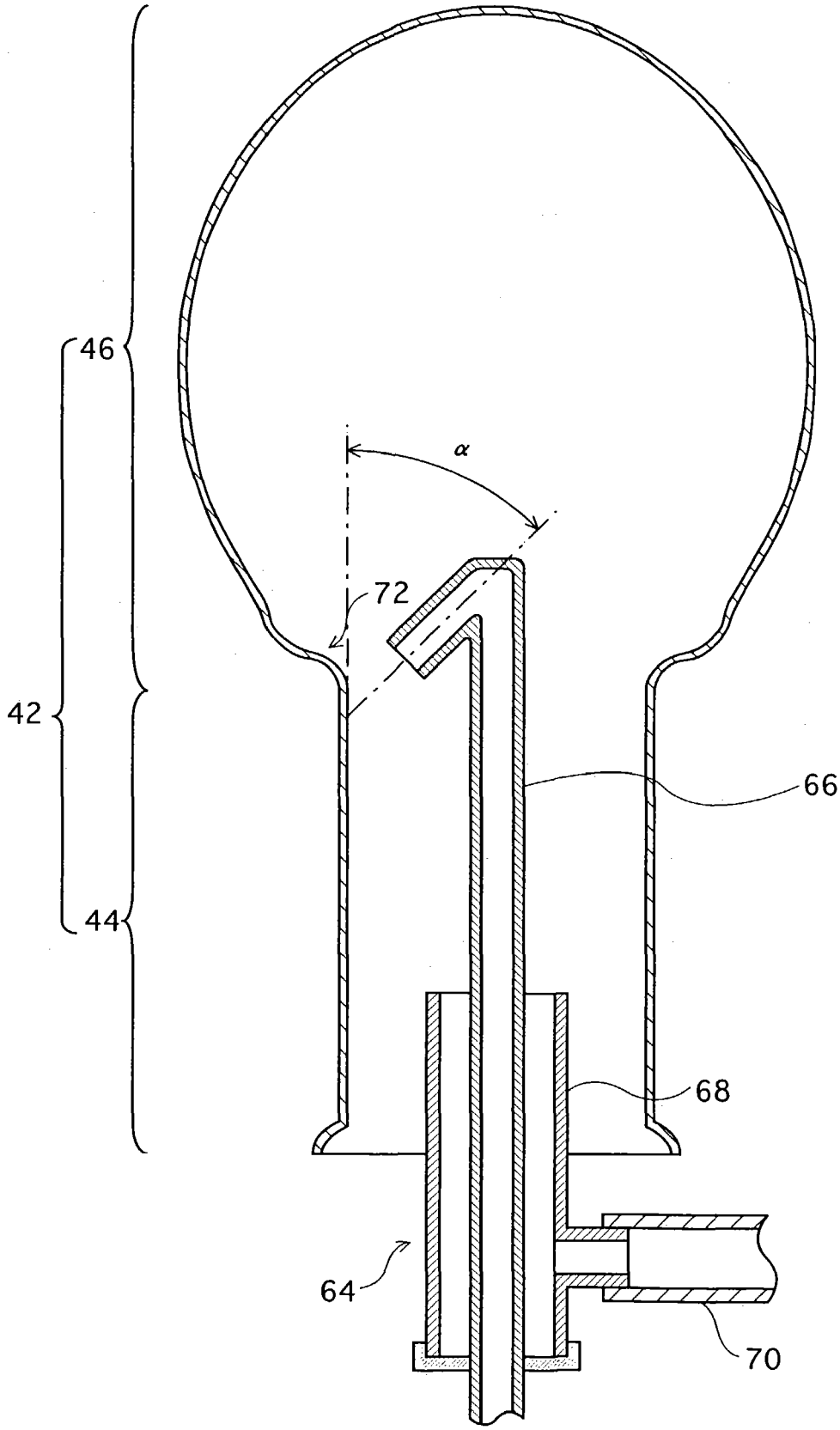
FIG. 6 is a diagram mainly showing the head part of the cleansing-suction apparatus that is used in the production process shown in FIG. 5.

FIG. 6 is a sectional view of the head part 64 of the cleansing-suction apparatus that is used for cleansing the application solution and removing the steam by suction. The entire body of the cleansing-suction apparatus is not shown in the drawing. The head part 64 has: a nozzle 66 for injecting the cleansing solution fed through the pump (not shown in the drawing); and a suction tube 68 for sucking in the steam. Note that pure water is used for the cleansing solution. The suction tube 68 is connected to a pipe 70 connected to the inlet of the blower (now shown in the drawing). The removal of the steam from the glass vessel 42 into the suction tube 68 is realized by the power of suction of the blower.

The end of the nozzle 66 is directed downward, so as to inject pure water to the inner surface of the cylindrical part 44, with an angle $\alpha$. The range of the angle $\alpha$ is detailed later. The injection position from which the pure water is injected is preferably as upper as possible within the cylindrical part 44. If the injection position is beyond the cylindrical part 44 and the injected pure water reaches the slope 72 situated above the cylindrical part 44, the inside of the spherical part 46 will be splattered with the injected pure water, thereby making the phosphor layer within the spherical part 46 uneven. On the other hand, if the injection position is too low, the sealing position should be accordingly lower in position. This will lead to a longer lamp vessel 12, and further to a longer electrodeless lamp 10.

Now, returning to FIG. 5, in Step ①, while the glass vessel 42 is being rotated in the direction of the arrow C, the application solution is removed by cleansing, with the pure water injected from the nozzle 66 of the aforementioned head part 64, and the steam is removed from the glass vessel 42 by suction of the suction tube 68. This cleansing is a rough cleansing. Note that until the later operations ②, ③, ④ have been complete, the glass vessel 42 is kept rotated in the direction of the arrow C.

In Step ② that follows, only drying of the application solution is performed. Therefore, only removal of the steam is performed by sucking the steam through the suction tube 74. The suction tube 74 is in a cylindrical shape, and the lower end thereof is connected to the inlet of the aforementioned blower, via the pipe 76.

In Step ③, cleansing and sucking are performed with use of the head part 78, just as in Step ①. This cleansing is the finishing process in cleansing. Note here that the head part 78 is the same kind as the head part 64 used in Step ①.

In the last step (Step ④), the suction tube 80 is used to suck the steam, so as to perform only drying of the application solution.

Note that below the route where the glass vessel 42 passes, a collection bath 82 is set for collecting the cleansed off application solution.

By going through the steps ①–④, unnecessary application solution is cleansed and removed off the glass vessel 42, and the application solution applied is dried, so as to form a phosphor layer at the desirable area described above.

The drying operation performed in the steps ①–④ makes the application solution becomes solid gradually from the side of the bottom of the glass vessel 42 to the side of the cylindrical part 42, and at the same time, the drying operation makes a small amount of the application solution in liquid form which is not yet solid go underneath along the glass vessel 42 (i.e. going along the spherical part 46 to the cylindrical part 44). The edge of the phosphor layer is formed by being cleansed with a liquid (pure water) under such a situation. This is the reason why this edge is shaped as aforementioned (details of part A, in FIG. 3). Furthermore, in view of preventing the phosphor from falling off, the vicinity of the edge of the phosphor layer 14 preferably forms a slope having an acute angle, relative to the inner surface of the cylindrical part 44 of the glass vessel 42. Accordingly, it is appropriate that the injection angle $\alpha$ (FIG. 6) of the pure water (cleansing solution) is smaller than 90° C.

Note that in the glass vessel 42, the final average thickness of the phosphor layer formed on the inner surface of the spherical part 46 is determined by the viscosity of the application solution and the drying speed at which the application solution is dried.

That is, the phosphor layer becomes thick, as the viscosity becomes high (i.e. as the fluidity of the application solution becomes low), and as the drying speed becomes fast. On the contrary, the phosphor layer becomes thin, as the viscosity thereof becomes low (i.e. as the fluidity of the application solution becomes high), and as the drying speed becomes slow. This is because the application solution applied on the inner surface of the spherical part 46 flows downward under its own weight, until becoming solid. Accordingly, the thickness of the layer of application solution (i.e. thickness of the phosphor layer) decreases.

The drying speed is, for example, adjustable by how deep the suction tube is entered into the glass vessel 42. The reason is as follows. The purpose of providing the suction tube is to suck mainly the steam generated inside the spherical part 46, so as to promote drying of the application solution on an inner surface of the spherical part 46. Therefore, as the opening of the suction tube (upper opening) gets close to the spherical part 46 (i.e. as it entered deep), the ratio of the steam becomes high in relation to the total amount sucked by the suction tube, thereby promoting the drying. On the contrary, as the opening gets close to the vicinity of the opening of the glass vessel 42 (i.e. as it enters shallow in the glass vessel 42), the ratio of the air (air outside the glass vessel 42) becomes high in relation to the total amount sucked by the suction tube, so as to decrease the ratio of the steam in relation to the total amount sucked by the suction tube. This will slowdown the drying.

In the aforementioned Step ①, the application solution is simultaneously cleansed and dried under a condition where the application solution is substantially non-dry. In this Step ①, it is impossible to enter the suction tube deep enough into the glass vessel 42, from the following reason. That is, if the suction tube is entered too deep, an air current yielded by the air sucked by the suction tube makes the cleansing solution wind up inside the spherical part 46, and drop on the inner surface of the spherical part 46. This will result in an uneven thickness of the application solution having been applied.

Therefore, at Step ①, the drying speed of the application solution is slower than that in Step ② (or in Step ④) where the suction tube is inserted deeper into the glass vessel 42.

In view of the above, in order to make the final phosphor layer thick, it is possible to perform only sucking of steam in Step ①, just as in Step ②, and to enter the suction tube deep into the glass vessel 42. Or, it is further possible to omit Step ①, and to perform Step ② for a period of time which is a summation of the time required for Step ② and the time required for Step ①.

In addition, in the aforementioned embodiment, the aqueous solution made of polyethylene oxide is used for the liquid into which the phosphor is mixed. However, not limited to this, the aqueous solution may be butyl acetate. That is, an application solution maybe obtained by mixing phosphor powders into butyl acetate. Note that in this case, the cleansing solution has to be butyl acetate.

The fluorescent lamp to which the present invention is applied is not limited to the aforementioned electrodeless fluorescent lamp. The essential point is that the fluorescent lamp has to have a hermetically sealed lamp vessel, and that a phosphor layer is on a part of the inner surface of the lamp vessel (i.e. there is an edge of the phosphor layer), for the present invention to be applicable thereto.

Although the present invention has been fully described by way of examples with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fluorescent lamp comprising:

a hermetically sealed lamp vessel; and a phosphor layer attached to a part of an inner surface of the lamp vessel, the phosphor layer having an edge and a portion adjacent to the edge, wherein a thickness of the portion adjacent to the edge gradually and smoothly decreases towards the edge and a thickness of the phosphor layer, except for the portion adjacent to the edge, is substantially uniform.

2. The fluorescent lamp of claim 1, wherein the phosphor layer is formed so that a slope is created on the portion adjacent to the edge, the slope having an acute angle with respect to the part of the inner surface of the lamp vessel.

3. The fluorescent lamp of claim 2, further comprising:

a discharge material that contains mercury, and is enclosed in the lamp vessel; and a coil that is provided outside the lamp vessel, and generates a magnetic field so as to make the discharge material induce a plasma discharge, wherein the plasma discharge causes the mercury to emit ultraviolet light, and the emitted ultraviolet light is converted into visible light by means of a phosphor material included in the phosphor layer.

4. The fluorescent lamp of claim 3, wherein the lamp vessel is made up of a glass bulb in a substantially spherical form, and an internal tube that is provided in the glass bulb and has a concave portion in a tube-like form, wherein the phosphor layer is formed on an inner surface of the glass bulb.

5. The fluorescent lamp of claim 4, wherein the coil is provided in the concave portion.

6. The fluorescent lamp of claim 5, wherein the phosphor layer is obtained by drying a mixture of an aqueous solution of polyethylene oxide and phosphor powders.

7. A fluorescent lamp comprising:

a hermetically sealed lamp vessel;

a phosphor layer attached to a part of an inner surface of the lamp vessel, wherein a thickness of the phosphor layer near an edge thereof gradually and smoothly decreases towards the edge, wherein the phosphor layer is formed so that a slope is created near the edge, the slope having an acute angle with respect to the part of the inner surface of the lamp vessel;

a discharge material that contains mercury, and is enclosed in the lamp vessel; and a coil that is provided outside the lamp vessel, and generates a magnetic field so as to make the discharge material induce a plasma discharge, wherein the plasma discharge causes the mercury to emit ultraviolet light, and the emitted ultraviolet light is converted into visible light by means of a phosphor material included in the phosphor layer.

8. The fluorescent lamp of claim 7, wherein the lamp vessel is made up of a glass bulb in a substantially spherical form, and an internal tube that is provided in the glass bulb and has a concave portion in a tube-like form, wherein the phosphor layer is formed on an inner surface of the glass bulb.

9. The fluorescent lamp of claim 8, wherein the coil is provided in the concave portion.

10. The fluorescent lamp of claim 7, wherein the phosphor layer is obtained by drying a mixture of an aqueous solution of polyethylene oxide and phosphor powders.

11. A fluorescent lamp comprising:

a hermetically sealed lamp vessel including an external tube, the external tube having a spherical part in a substantially spherical form and a tubular part; and a phosphor layer attached to a substantially entire inner surface of the external tube in a manner that an edge of the phosphor layer is positioned at an inner surface of the tubular part, a thickness of the phosphor layer near the edge gradually and smoothly decreasing towards the edge and a thickness of the phosphor layer on the spherical part being substantially uniform.

12. The fluorescent lamp of claim 11, wherein the phosphor layer is formed so that a slope is created near the edge, the slope having an acute angle with respect to the part of the inner surface of the lamp vessel.

13. The fluorescent lamp of claim 12, wherein the spherical part and the tubular part are connected by a connecting part in a substantially S-letter form made of two portions in arc-like forms in a longitudinal cross section.

14. The fluorescent lamp of claim 13, further comprising:

a discharge material that contains mercury, and is enclosed in the lamp vessel; and a coil that is provided outside the lamp vessel, and generates a magnetic field so as to make the discharge material induce a plasma discharge, wherein the plasma discharge causes the mercury to emit ultraviolet light, and the emitted ultraviolet light is converted into visible light by means of a phosphor material included in the phosphor layer.

15. The fluorescent lamp of claim 14, wherein the lamp vessel further includes an internal tube, the internal tube being provided in the external tube and having a concave portion in a tube-like form.

16. The fluorescent lamp of claim 15, wherein the coil is provided in the concave portion.

17. The fluorescent lamp of claim 16, wherein the phosphor layer is obtained by drying a mixture of an aqueous solution of polyethylene oxide and phosphor powders.

* * * * *